US006032312A

United States Patent [19]

Hope et al.

[11] Patent Number: 6,032,312

[45] Date of Patent: Mar. 7, 2000

[54] OBJECT CLEANING DEVICE

[75] Inventors: Lee A. Hope, Granger, Ind.; Charles E. Rhodes, Niles, Mich.

[73] Assignee: Ball-O-Matic, Inc., Niles, Mich.

[21] Appl. No.: 09/013,692

[22] Filed: Jan. 26, 1998

[51] Int. Cl.[7] ..... A46B 13/00

[52] U.S. Cl. ..... 15/21.2; 15/3.13; 15/3.16

[58] Field of Search ..... 15/21.2, 3, 3.1, 15/3.11, 3.12, 3.13, 3.15, 3.16, 3.17, 3.18, 3.19, 3.2, 21.1, 97.1; 134/6, 133, 134

[56] References Cited

U.S. PATENT DOCUMENTS

| | | | |
|---|---|---|---|
| 455,564 | 7/1891 | Harris . | |
| 482,937 | 9/1892 | Bardsley et al. . | |
| 503,210 | 8/1893 | Learned . | |
| 703,916 | 7/1902 | Haley . | |
| 790,834 | 5/1905 | Harvey . | |
| 1,058,461 | 4/1913 | Porter . | |
| 1,676,306 | 7/1928 | White . | |
| 1,798,322 | 3/1931 | Floyd et al. . | |
| 1,807,023 | 5/1931 | Young . | |
| 1,876,851 | 9/1932 | Burg . | |
| 2,005,115 | 6/1935 | Stutz . | |
| 2,454,090 | 11/1948 | Reading . | |
| 2,590,381 | 3/1952 | Currie . | |
| 2,691,786 | 10/1954 | Reading . | |
| 2,847,697 | 8/1958 | Bried . | |
| 2,851,829 | 9/1958 | Martin . | |
| 3,038,186 | 6/1962 | Davy . | |
| 3,075,214 | 1/1963 | Nelson . | |
| 3,083,389 | 4/1963 | Wittek . | |
| 3,120,669 | 2/1964 | Montuori . | |
| 3,125,775 | 3/1964 | Clifton . | |
| 3,148,566 | 9/1964 | Nishibayashi . | |
| 3,592,689 | 7/1971 | Chaplinski . | |
| 3,733,633 | 5/1973 | Gustafson . | |
| 3,820,183 | 6/1974 | Gustafson et al. . | |
| 4,181,996 | 1/1980 | Hollrock . | |
| 4,217,917 | 8/1980 | Kilpelainen . | |
| 4,448,118 | 5/1984 | Kunz . | |
| 4,708,830 | 11/1987 | Shepherd et al. | 261/70 |
| 4,773,114 | 9/1988 | Thrasher . | |
| 4,805,251 | 2/1989 | Hollrock . | |
| 4,970,746 | 11/1990 | Brackmann . | |
| 5,077,854 | 1/1992 | Moons . | |
| 5,139,577 | 8/1992 | Brock . | |
| 5,228,168 | 7/1993 | Hollrock et al. . | |
| 5,331,702 | 7/1994 | Willsey et al. . | |
| 5,332,350 | 7/1994 | Hollrock et al. . | |
| 5,353,822 | 10/1994 | Gutterman et al. | 134/133 |

(List continued on next page.)

FOREIGN PATENT DOCUMENTS

| | | |
|---|---|---|
| D 328 855 01 | 4/1994 | European Pat. Off. . |
| 872491 | 7/1961 | United Kingdom . |

OTHER PUBLICATIONS

Ball–O–Matic *A World of Golf 1997 Equipment Catalog*, pp. 4, 8, 10, 11, USA and Canada.

Teutonix, Inc. Model EX87 Golf Ball Washer Brochure, approximately 1987–88, USA and Canada.

Rangemaster Equipment Brochure, pp. 14–17 No Date Available.

Hollrock Engineering Brochure for "Range Servant" equipment and golf ball washers No Date Available.

*Primary Examiner*—Gary K. Graham
*Assistant Examiner*—Andrew Aldag
*Attorney, Agent, or Firm*—Young & Basile, P.C.

[57] ABSTRACT

An object cleaning device for cleaning objects such as golf balls is disclosed. The device comprises a cleaning element including an inlet end for receiving objects and an outlet end for discharging objects, the cleaning element further comprising a rotatable body including at least a first interior object cleaning surface, and a stationary track interior of the rotatable body. The stationary track defines a path of travel for objects between the inlet and outlet ends of the cleaning element. A drive mechanism rotates the rotatable body relative to the stationary track such that rotation of the rotatable body relative to said stationary track causes the movement of objects from the inlet end to the outlet end of the cleaning element along the stationary track.

34 Claims, 10 Drawing Sheets

OTHER PUBLICATIONS

| | | | |
|---|---|---|---|
| 5,520,457 | 5/1996 | Gontero et al. . | |
| 5,529,082 | 6/1996 | Weimer et al. | 134/133 |
| 5,542,440 | 8/1996 | Weimer et al. | 134/133 |
| 5,551,118 | 9/1996 | Yeh | 15/21.2 |
| 5,638,567 | 6/1997 | Danyluk | 15/21.2 |
| 5,647,082 | 7/1997 | Garske et al. | 15/21.2 |
| 5,647,089 | 7/1997 | Hollrock | 15/21.2 |
| 5,711,330 | 1/1998 | Nelson | 134/133 |
| 5,772,778 | 6/1998 | Back | 15/21.2 |

43
43
63
62
89
87
80
79
88
64
65
67
68
66

43
85
80
79
85
69
69'
68
67
70
65
66
43

83
84
42
86
82
86
81
78
76
77
75
39

OBJECT CLEANING DEVICE

BACKGROUND OF THE INVENTION

The present invention relates to devices for cleaning objects, including golf balls and the like, and more particularly to such a device including a cleaning element comprising a rotatable body for rotation about a stationary track interior of the body, the body including at least a first interior abrasive object cleaning surface to simultaneously clean and convey objects along the stationary track from an inlet end to an outlet end of the cleaning element as the rotatable body is rotated by a drive mechanism relative to the stationary track.

Devices for cleaning and/or washing objects have been around for a number of years, and find applications ranging from cleaning produce, eggs, and candy to cleaning golf balls. See, e.g., Porter, U.S. Pat. No. 1,058,461 (teaching a fruit cleaner); Reading, U.S. Pat. Nos. 2,454,090 and 2,691,786 (disclosing an egg washer); and Currie, U.S. Pat. No. 2,590,381 (teaching a candy cleaning machine).

Demand for high volume, efficacious cleaning devices is particularly pronounced in the golf industry. Indeed, there exist today thousands of golf courses in the United States alone, many of which offer golf swing practice, or driving, ranges. There are, additionally, myriad independent, or stand alone, driving ranges. Efficient and cost-effective cleaning of golf balls for these driving ranges is a competitive necessity, as manual cleaning or cleaning by mechanically simple, low-output-volume devices is not economical.

Devices particularly directed to cleaning and/or washing golf balls are known, varying in mechanical complexity from simple, manually operated, single golf ball cleaning devices, punctuating the landscape of virtually every golf course in this country, to automated apparatus for cleaning hundreds upon thousands of golf balls in a relatively short time. An example of the former device may be found in A. P. Young, U.S. Pat. No. 1,807,023, while golf ball washers of the latter variety may be found in Thrasher, U.S. Pat. No. 4,773,114, and Hollrock, U.S. Pat. No. 4,805,251.

However, an object cleaning device of the type of the present invention, having as one of its applications the cleaning of golf balls, has been heretofore unknown.

SUMMARY OF THE INVENTION

It is, accordingly, one object of the present invention to provide a novel device for cleaning objects, such as golf balls, which device is both efficient and simple to operate and maintain.

In accordance with the present invention, an object cleaning device comprises a cleaning element having a rotatable body including at least a first interior abrasive object cleaning surface, and a stationary track interior of the rotatable body, the stationary track defining a path of travel for objects between an inlet end and an outlet end of the cleaning element. A drive mechanism rotates the rotatable body relative to the stationary track to effect the conveyance of objects along the stationary track between the inlet end and the outlet ends of the cleaning element. According to one feature of this invention, at least a second, stationary abrasive object cleaning surface is provided, preferably on a shaft provided interior of the stationary track so as to be in opposition to the object cleaning surface of the rotatable body. According to another feature of this invention, the stationary path defines a helix winding about the shaft and the at least first and second abrasive object cleaning surfaces are spaced radially apart such that an object being cleaning is simultaneously cleaned by both object cleaning surfaces. According to one embodiment of the present invention, the stationary track and rotatable body are substantially vertically oriented, such that rotation of the rotatable body relative to the stationary track effects the vertically upwards conveyance of objects along the stationary track between the inlet and outlet ends of the cleaning element.

According to one feature of the invention, at least a first rinse station is provided for rinsing objects in the object cleaning device, the at least first rinse station communicating with a supply of liquid. Preferably at least a second such rinse station is also provided, the second rinse station also communicating with a supply of liquid. The at least first rinse station is preferably provided prior to the inlet end of the cleaning element and the at least a second rinse station provided after the outlet end of the cleaning element. The at least first and second rinse stations preferably communicate with a common supply of liquid through a valved supply conduit, such that the rinse stations are independently selectively operable.

A reservoir is provided for a cleaning liquid, the cleaning element receiving objects from the reservoir at the inlet end thereof. An automatic liquid supply valve communicates with a supply of a cleaning liquid and serves to automatically regulate the amount of liquid in the reservoir. According to another feature, the object cleaning device further comprises a housing containing the cleaning element. Inlet and outlet ends of the housing communicate with the inlet and outlet ends of the cleaning element. According to one embodiment of the present invention, the housing inlet comprises an object sorting tray comprising a basin being ramped for the gravity conveyance of objects to be cleaned into the housing. The object sorting tray further includes an object sorting track provided prior to the inlet end of the cleaning element, the at least one object sorting track separating debris from the objects to be cleaned. The object sorting track comprises a channel provided intermediate of inwardly sloping basin walls and terminating in an opening adapted to receive objects into the housing. The inwardly sloping basin walls provide for gravity conveyance of objects to be cleaned to the at least one object sorting track. The at least one object sorting track further comprises a channel having a width less than the diameter of the objects to be cleaned and a depth greater than the radius of the objects to be cleaned. According to an alternate embodiment, the object sorting tray comprises a basin being ramped, the basin including a plurality of object sorting tracks, each object sorting track terminating in a opening through the housing. Each object sorting track is adapted to convey objects therealong in end-to-end relation.

An object transfer passageway extends between and communicates the object sorting tray with the vertically lower inlet end of the cleaning element, the object transfer passageway comprising in one embodiment a rigid passageway, a flexible transfer conduit, and a feed tube. According to another embodiment, the object transfer passageway comprises a ramped chute of decreasing cross-section, a flexible transfer conduit, and a feed tube.

According to a further feature of this invention, the housing houses the drive mechanism and reservoir. The housing, according to another feature of the present invention, comprises at least first and second hingedly connected halves and a removable cover, the reservoir being defined in one of the first or second hingedly connected halves, and the basin and at least one object sorting track being provided on the cover.

These and other objects and advantages of the present invention will be more fully appreciated upon reference to the specification, including the drawings, which comprise:

DESCRIPTION OF THE ILLUSTRATED EMBODIMENT

Figure 1:
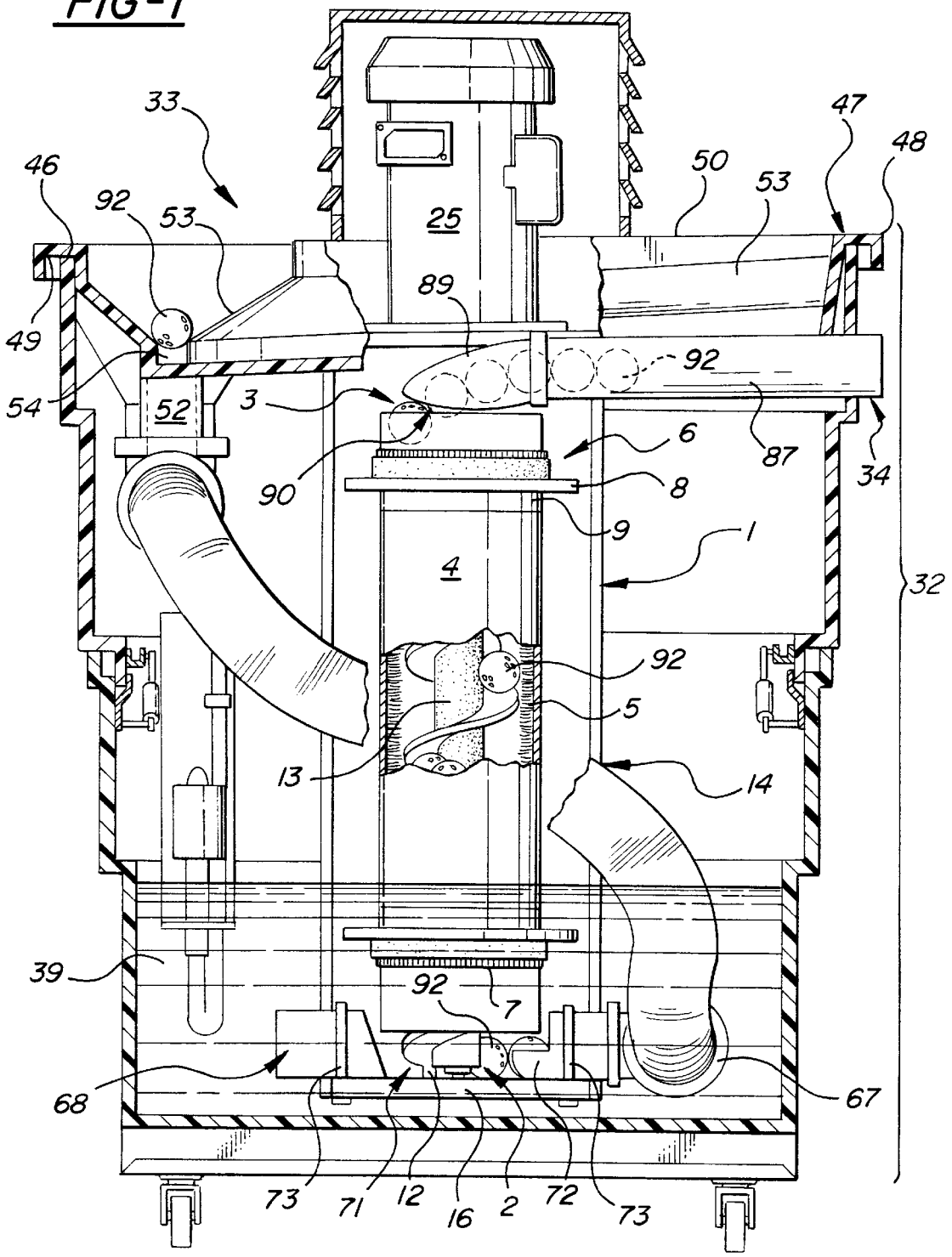
FIG. 1 is a frontal cross-sectional view of the present invention.

Referring now to the drawings, the object cleaning device of the present invention is shown in greater detail in its preferred embodiment. For the sake of brevity, the device is depicted in a golf ball cleaning application, to which it is certainly well suited. Of course, those of skill will understand that the device of the present invention is suitable for other cleaning applications, for example the cleaning of produce. It will also be appreciated that this specification is only illustrative of one embodiment of the present invention, according to one particular application, and that numerous changes and modifications thereto, apparent to those of skill in the art, are possible without departing from the spirit and broader aspects of the invention as set forth in the appended claims.

Figure 2:
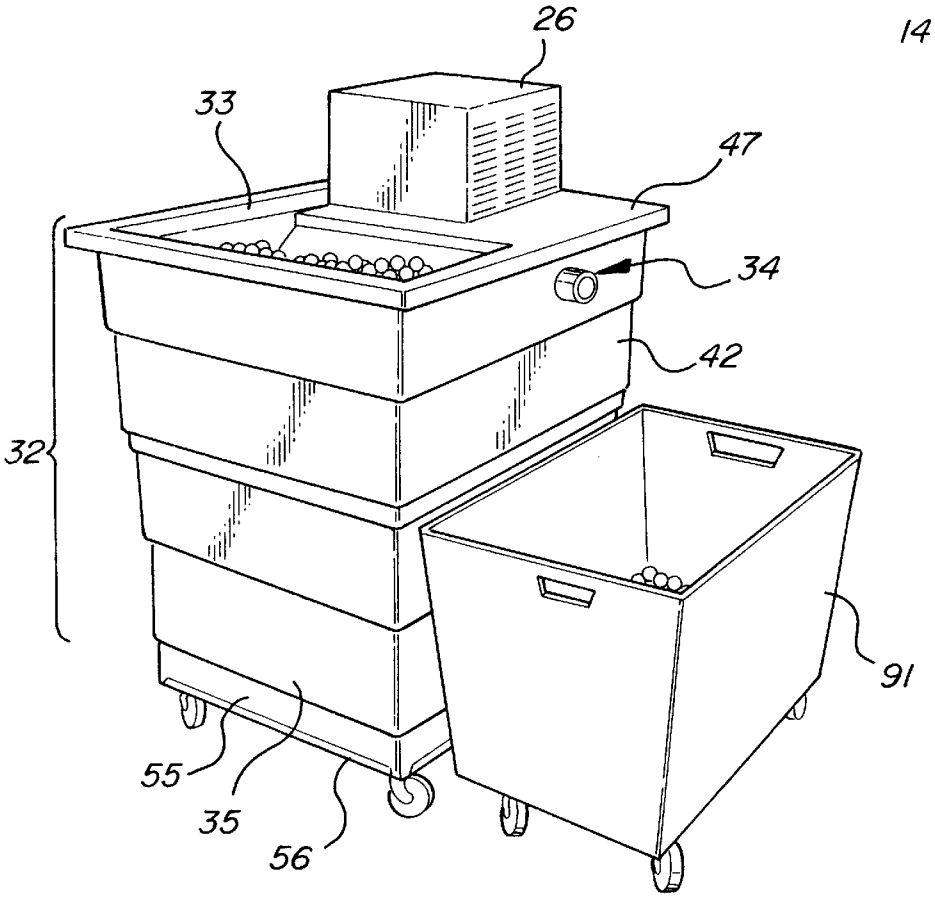
FIG. 2 is a top quartering perspective view of the present invention, shown in one possible operational configuration.

Turning first to FIG. 1, the device of the present invention will be seen to most generally comprise a cleaning element 1 for cleaning objects, the cleaning element including an inlet end 2 for receiving objects to be cleaned, and an outlet end 3 for discharging cleansed objects, a rotatable body 4 including at least a first interior abrasive object cleaning surface 5, and a stationary track 11 interior of rotatable body 4, the stationary track defining a path of travel for objects between inlet 2 and outlet 3 ends. A drive mechanism including a drive motor 25 rotates the rotatable body 4 relative to stationary track 11 to effect the conveyance of objects between inlet 2 and outlet 3 ends. A housing 32, shown additionally in FIG. 2, is preferably provided for housing cleaning element 1, the housing having both an inlet 33 for objects to be cleaned, and an outlet 34 providing for the conveyance of cleansed objects out of housing 32. Still referring also to FIG. 1, a reservoir 39 for a cleaning liquid preferably communicates with inlet end 2, the reservoir preferably being provided within housing 32. While a receptacle 91 comprising a cart is shown in FIG. 2 in combination with the cleaning device of the present invention to receive cleansed objects from discharge outlet 34, receptacle 91 does not form a component of the present invention.

Figure 3:
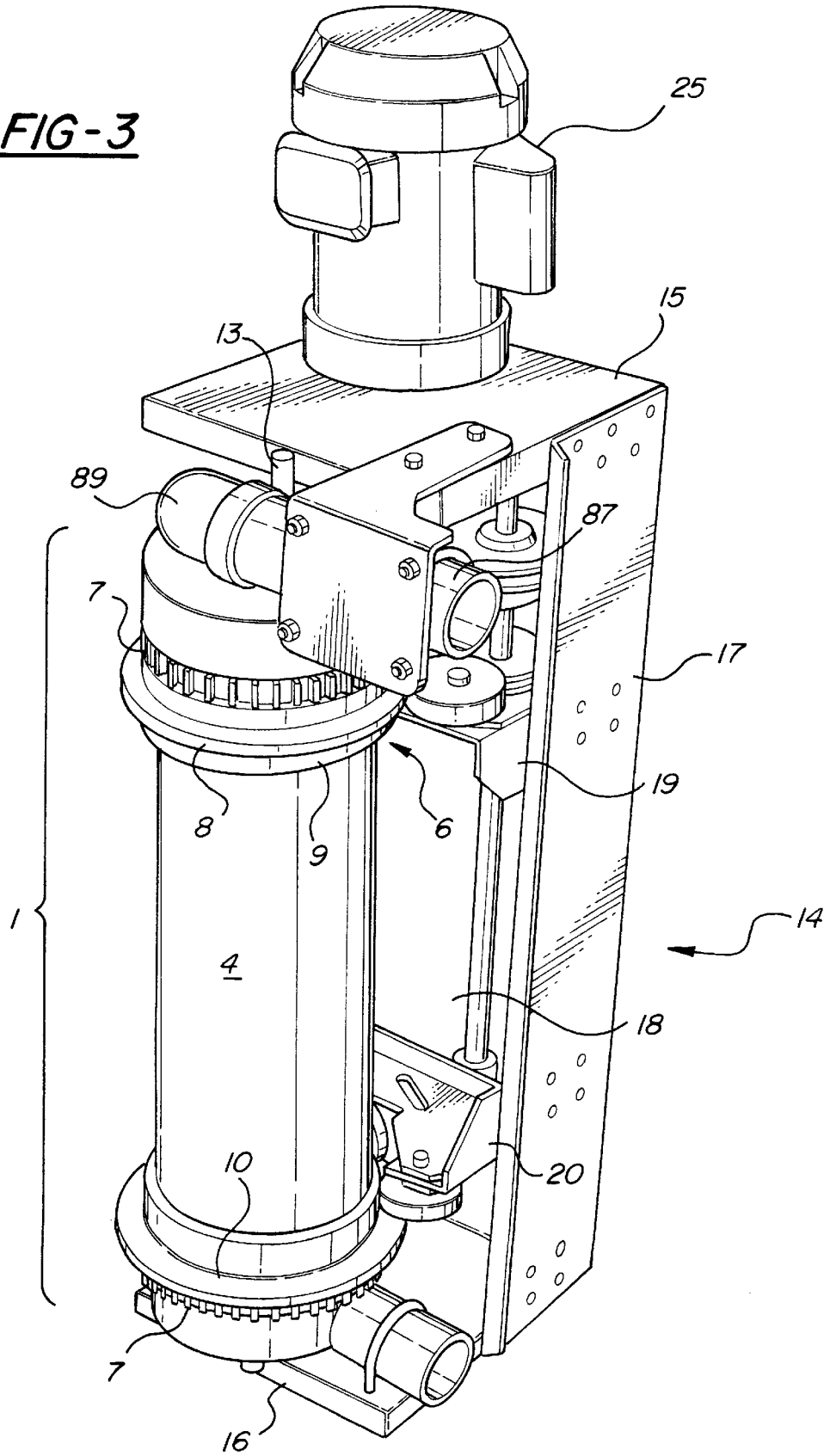
FIG. 3 is a top quartering perspective of the cleaning element of the present invention.

Turning next to FIGS. 1 and 3, cleaning element 1 of the present invention will be better understood. As shown, rotatable body 4 comprises a cylindrical drum having a passageway defined therethrough between vertically opposite open ends. Body 4 is preferably manufactured from a suitably durable polymer, such as polyethylene, polyvinylchloride, or the like. In the illustrated embodiment, a first, interior abrasive object cleaning surface 5 takes the form of a brush lining provided on the interior surface of rotatable body 4 and extending substantially continuously between the vertically opposite open ends thereof. Disposed proximate opposite open ends of rotatable body 4 on the exterior thereof are provided collars 6. Each collar 6 comprises driven gears 7, such as the illustrated toothed gear belt pulleys, radially extending annular flanges 8 adjacent each driven gear 7, and circumferential roller surfaces 9. A further roller surface 10 is defined on the radial surface of each flange 8. In the illustrated form, collars 6 are fixed to rotatable body 4 by means of pin screws provided radially through flanges 8. Collar 6 is preferably fashioned as a unitary element to include each of driven gears 7, flanges 8 and roller surfaces 9 and 10, although those of skill will appreciate that these driven gears, flanges and roller surfaces may also comprise separate elements. Each collar 6 is preferably fabricated from a suitable polymer, such as glass-filled nylon, though a suitably durable and non-corrosive metal such as stainless steel or aluminum may also be used.

Stationary track 11 is coaxial with rotatable body 4, and defines a substantially vertical path for the objects between inlet 2 and outlet 3 ends of cleaning element 1. In the preferred embodiment, track 11 defines a helical shape. The diameter of track 11 is preferably dimensioned so as not to interfere with the rotation of rotatable body 4. At least a second, stationary abrasive object cleaning surface is provided to clean objects in addition to first object cleaning surface 5. In the illustrated embodiment, the second abrasive object cleaning surface takes the form of a tufted-brush shaft 13 extending between and removably fixed at opposite terminal ends thereof to carriage 14 (FIG. 3). Shaft 13 is preferably longer than rotatable body 4, as shown, so as to provide clearance at inlet 2 and outlet 3 ends for the passage of objects. The second, abrasive object cleaning surface of shaft 13 radially opposes, and is vertically co-extensive with, first object cleaning surface 5: The distance between opposing first and second abrasive object cleaning surfaces being ideally slightly less than the diameter of the object being cleaned, for example the typical golf ball shown in the Figures, such that objects conveyed through cleaning element 1 are subjected to cleaning by both object cleaning surfaces. Track 11 is coaxial with and fixed to shaft 13 at the upper end thereof. Tab 12 provided at the terminally lower end of track 11 is removably receivable within a correspondingly-shaped slot (not shown) provided in lower wall 16 of carriage 14 to prohibit rotational movement of track 11 during operation of cleaning element 1.

Figure 4:
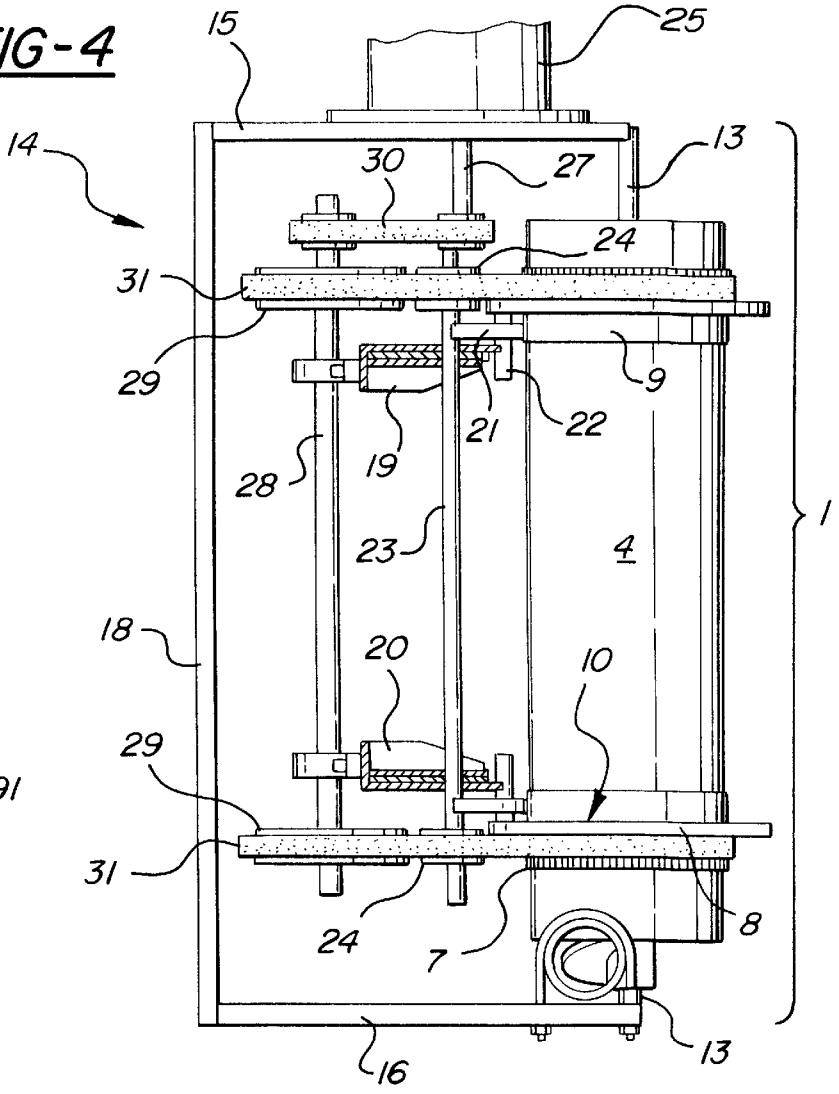
FIG. 4 is a lateral cut-away view showing the cleaning element and drive mechanism of the present invention.
Figure 5:
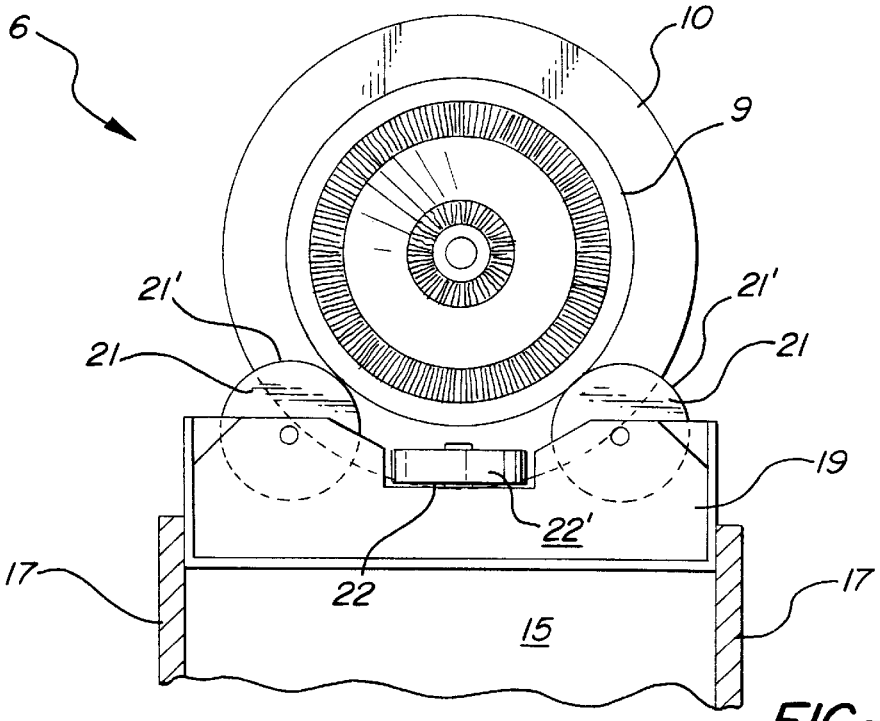
FIG. 5 is a bottom-up partial cut-away view of the cleaning element of FIG. 3.

Turning next to FIGS. 3 through 5, cleaning element 1 is supported on a metal carriage 14 comprising opposing upper 15 and lower 16 walls, opposing side walls 17, and rear wall 18. Carriage 14 is preferably fabricated from a non-corrosive metal, such as aluminum or stainless steel. Shaft 13 is preferably removably fixed to upper 15 and lower 16 walls to facilitate removal of cleaning element 1 therefrom for necessary maintenance or replacement. Referring particularly to FIGS. 3 through 5, carriage 14 further includes a pair of vertically spaced-apart upper 19 and lower 20 transverse, flanged brackets extending between and fastened to side walls 17, each bracket 19 and 20 supports a pair of freely rotatable, horizontal support/guide rollers 21 and a third freely rotatable vertical support/guide roller 22. Rollers 21 and 22 preferably comprise low friction roller surfaces: Roller surfaces 21' of rollers 21 rideable along roller surfaces 9 of collar 6 at separate tangential points, as shown in FIG. 5; roller surface 22' of each vertical roller 22 rideable along one of roller surfaces 10. Rollers 21 and 22 are preferably manufactured from a suitable polymer such as UHMW, but may also be manufactured from nylon, Teflon®, or the like. With transmission belts 31 coupling driven gears 7 and force transmitting gears 29, as described more fully below, and cleaning element 1 otherwise fixed to carriage 14, it will be appreciated that rollers 21 and 22 serve to support rotatable body 4 in a fixed, substantially vertical position and guide the smooth rotation thereof during operation of the present invention.

Referring now to FIG. 4, the drive mechanism includes an electric drive motor 25 fixed to upper wall 15 of carriage 14 and powered by an appropriate power source (not shown). A vented cowling 26 seated exteriorly atop cover 47 houses a portion of drive motor 25 protruding therewithin. (FIG. 2.) A first magnetic cut-off switch or micro-switch (not shown) of the type commonly known is provided to prevent operation of drive motor 25 when housing 32 is in an open condition. A second such magnetic cut-off switch or micro-switch (not shown) is also preferably provided to prevent operation of drive motor 25 when cover 47 is removed from housing 32. Of course, motor 25 need not be electric. Indeed, it is within the scope of this invention—and will be appreciated by those of skill in the art—that the drive mechanism may be manually operated, though less efficiently. Still referring to FIG. 4, drive motor 25 rotates rotatable body 4 through operation of drive shaft 27 extending through upper wall 15 of carriage 14. Driven shaft 28 extends vertically between and is journalled to upper 19 and lower 20 transverse brackets. A pair of force transmitting gears 29, such as the illustrated toothed belt pulleys, are fixed along the length of driven shaft 28, one each aligned in the same horizontal plane with a driven gear 7. Drive shaft 27 is operatively connected to and rotates driven shaft 28 by first rotation transmitting means such as the illustrated drive belt 30. Second rotation transmitting means, such as the illustrated toothed transmission belts 31, each couple one of force transmitting gears 29 and driven gears 7, translating rotation of driven shaft 28 to rotatable body 4. A further shaft 23 fixed to upper 19 and lower 20 flanged brackets supports freely rotatable idler rollers 24, one roller 24 engaging a length of one of toothed transmission belts 31 to eliminate slack in the movement thereof. Of course, those of skill will appreciate that other mechanical arrangements for translating rotation from drive motor 25 to rotatable body 4, such as meshed gears, may be substituted for the transmission and/or drive belts of the illustrated embodiment.

Figure 6:
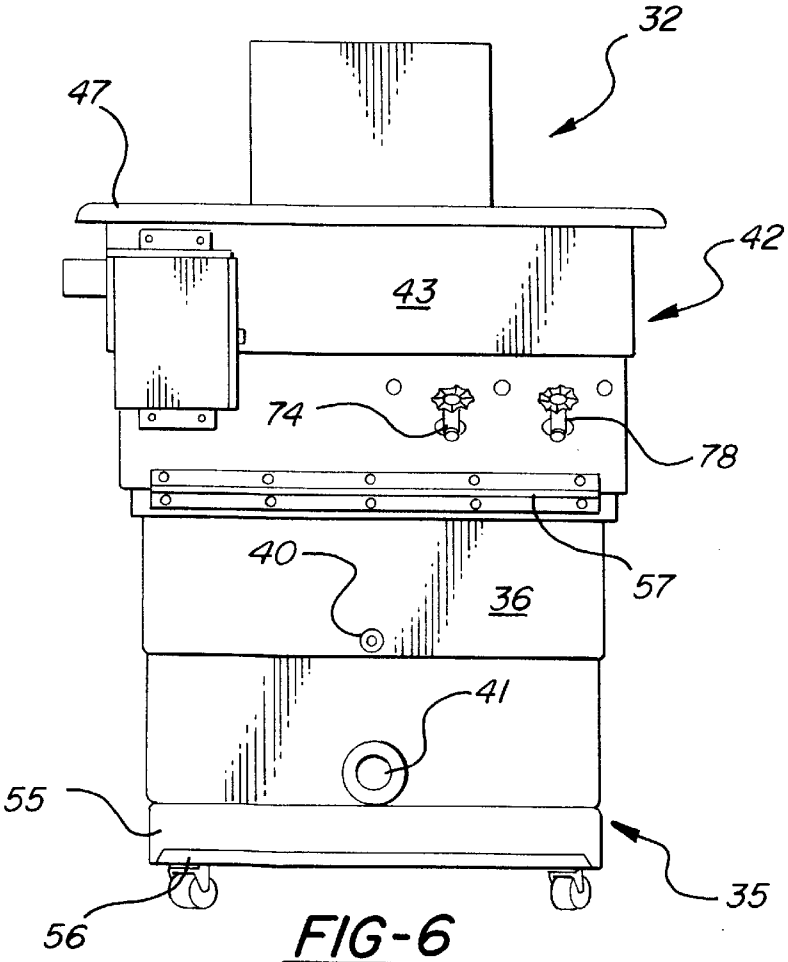
FIG. 6 is a rear elevational view of the housing of the present invention.
Figure 8A:
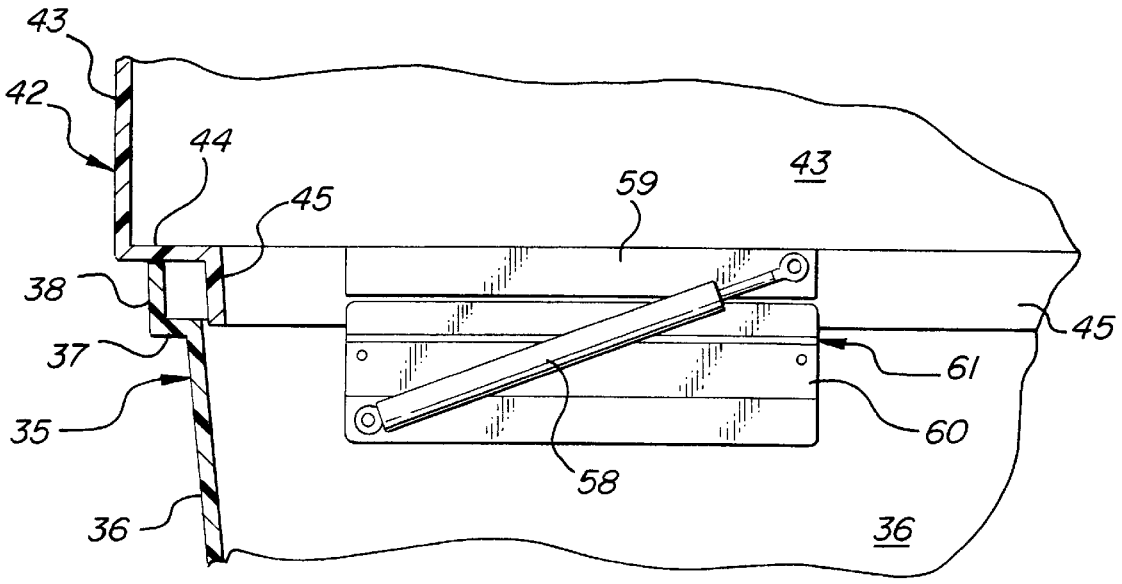
FIG. 8A is a lateral cut-away view of one interior side of the housing, illustrating the gas spring employed in the present invention to maintain the housing in an open condition.
Figure 8B:
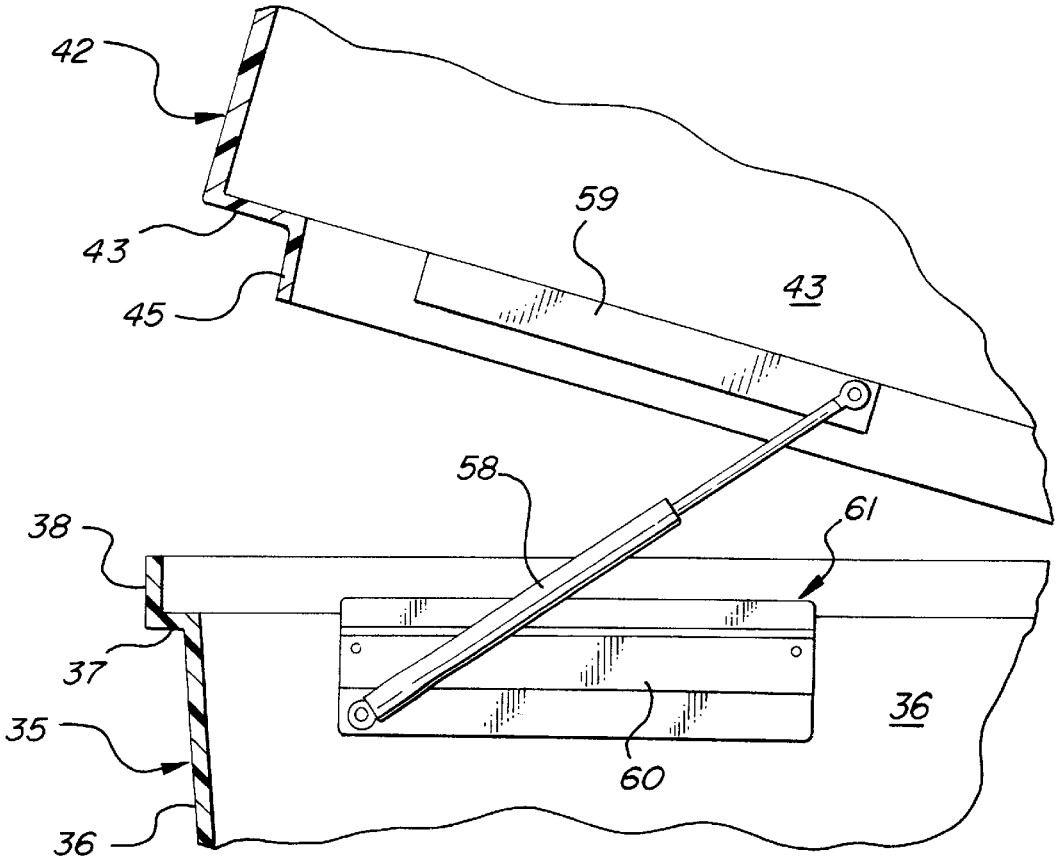
FIG. 8B is a lateral cut-away view of one interior side of the housing, illustrating the gas spring of FIG. 8A in an extended condition.

As shown best in FIGS. 6 through 8B, housing 32 includes a first, lower half 35, a second, upper half 42, and a cover 47, each preferably manufactured from a polymer of suitable durability and resistance to the corrosive effects of cleaning liquids. In the illustrated form, housing 32 is molded from polyethylene such that each of lower 35 and upper 42 halves, and cover 47 are seamless, so as to prevent leakage. Housing 32 may be provided with one or more height adjusting pedestals 55 on the bottom exterior surface of lower half 35 to change the overall height of inlet 33 and outlet 34, as desired, and/or a roller frame 56 including casters to facilitate relative ease of movement of the entire device. Halves 35 and 42 are connected along adjacent parallel edges by hinge 57 on rear side of housing 32, as shown in FIG. 6, to permit access to the interior of the housing. Housing 32 is depicted in such an open configuration in FIG. 7. A pair of gas springs 58 provided interiorly of housing 32 on opposite side walls thereof, as illustrated, extend between and are pivotally connected to upper 59 and lower 60 brackets fixed to side walls 43 of upper 42 half and side walls 36 of lower 35 half. (FIG. 8A.) Gas springs 58 are of known type and facilitate hinged movement of upper half 42 relative to lower half 35, permitting housing 32 to be easily maintained in an open configuration. (FIG. 8B.)

Referring particularly to FIGS. 8A and 8B, it will be seen that lower 35 and upper 42 halves of housing 32 are preferably designed to interrelate in the closed condition such that upper half 42 is supported by lower half 35 and cleaning liquid does not spill unnecessarily in the event the housing is moved away from a normal orientation. A continuous horizontal shoulder 37 extends radially outwards of side walls 36 and terminates in an upwardly vertically extensive and continuous bearing collar 38. Upper half 42 includes a similarly continuous horizontal shoulder 44 extending radially inwards of side walls 43 thereof, the shoulder terminating in a downwardly vertically extensive, continuous collar 45. Shoulder 44 defines a supported surface opposable to and seatable on bearing collar 38 in the closed condition of housing 32. In the closed condition (FIG. 8A), collar 45 extends interiorly downwards within interior of lower half 35 in lap relation to bearing collar 38, preventing unnecessary spillage of cleaning liquid from housing 32 at the juncture of lower 35 and upper 42 halves. Seating surface 61 defined by outwardly flared portion of lower bracket 60, receives and further supports collar 45.

As illustrated most clearly in FIG. 1, at least a portion of the interior area of lower half 35 preferably defines liquid reservoir 39. The capacity of reservoir 39 is limited by ¾" overflow drain 40, which drain communicates reservoir 39 with the exterior of lower half 35. (FIG. 6.) Effluent cleaning liquid from drain 40 may be captured in any desired container (not shown). Alternatively, a drainage tube (not shown) may be provided to carry effluent cleaning liquid, such as by gravity feed, from overflow drain 40 to an external drain (not shown). In the illustrated embodiment, reservoir 39 defines a 30 gallon maximum capacity, which has been shown to be sufficient for operation of the cleaning device present invention. Still referring to FIG. 6, vertically lower 2" discharge drain 41 also communicates reservoir 39 with the exterior of lower half 35. Discharge drain 41 preferably comprises a ball-type valve disposed proximate the bottom surface of reservoir 39, so as to permit both comprehensive draining of reservoir 39 as necessary in order to replace soiled cleaning liquid with fresh cleaning liquid, as well as removal of accumulated dirt and debris from the surfaces of lower half 35.

Cover 47 is completely removable from upper half 42; the cover being formed with an integral lip 48 defining a peripheral supported surface 49 for seating on seating surface 46 defined along the terminal upper edge of upper half 42. (FIG. 1.)

Figure 9C:
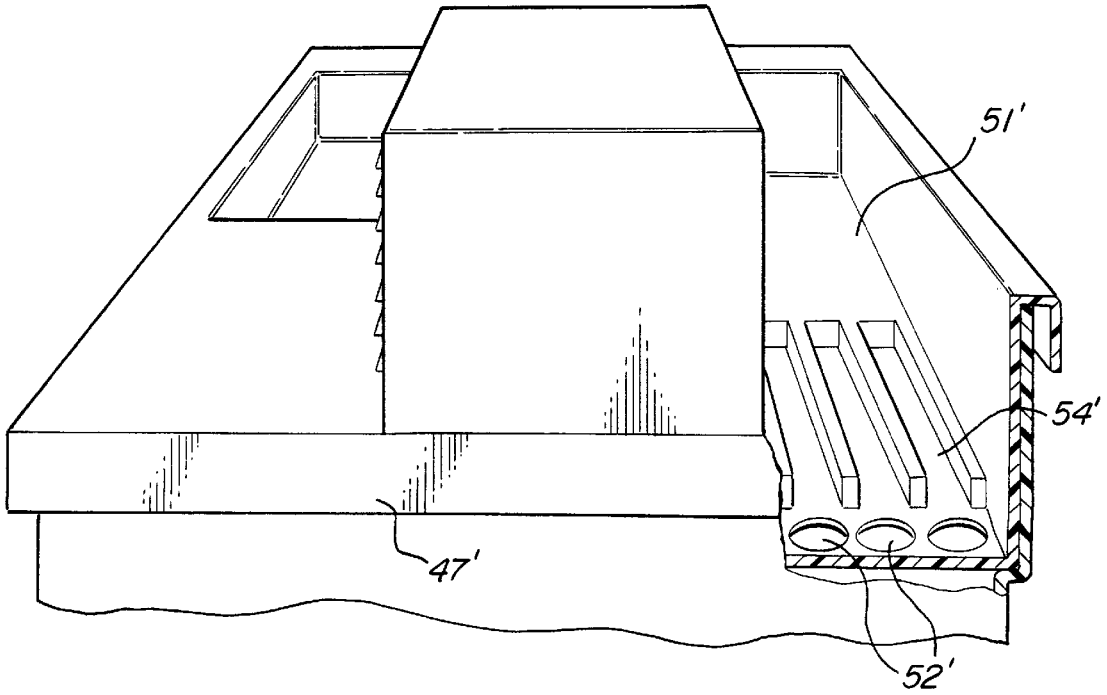
FIG. 9C is a partial rear perspective view of the object sorting tray according to an alternative embodiment of the present invention.
Figure 7:
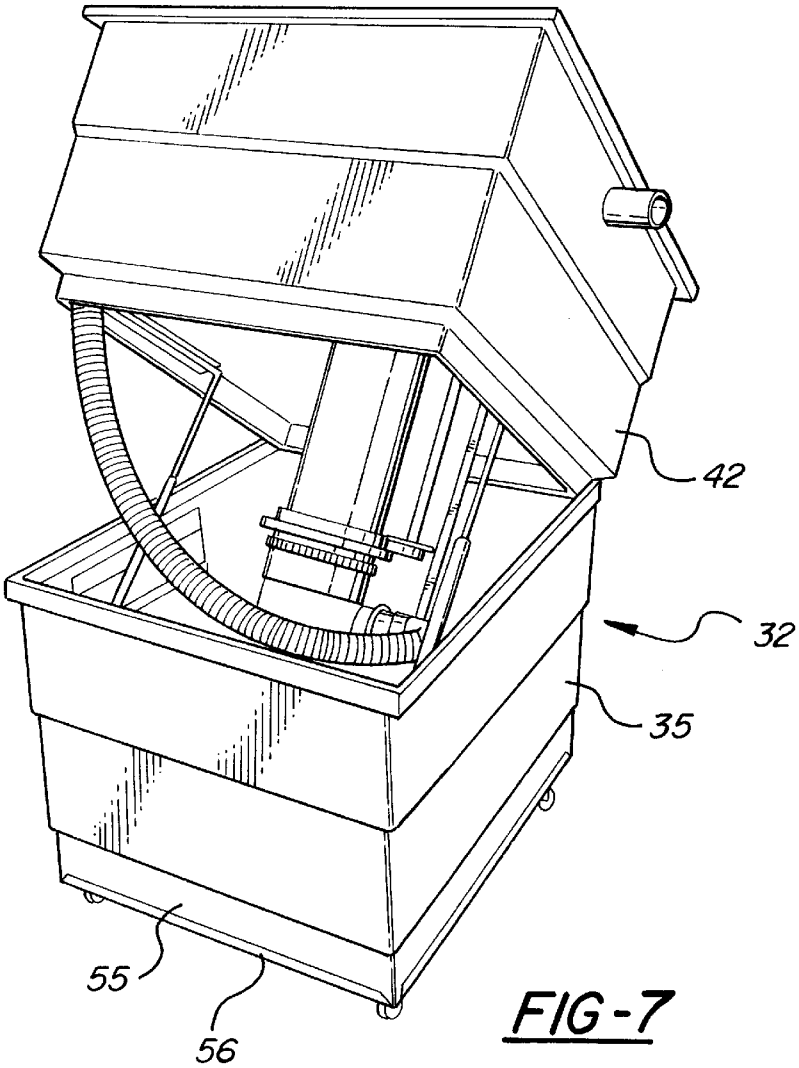
FIG. 7 is a top quartering perspective view of the present invention, illustrating the housing thereof in an open condition.
Figure 9:
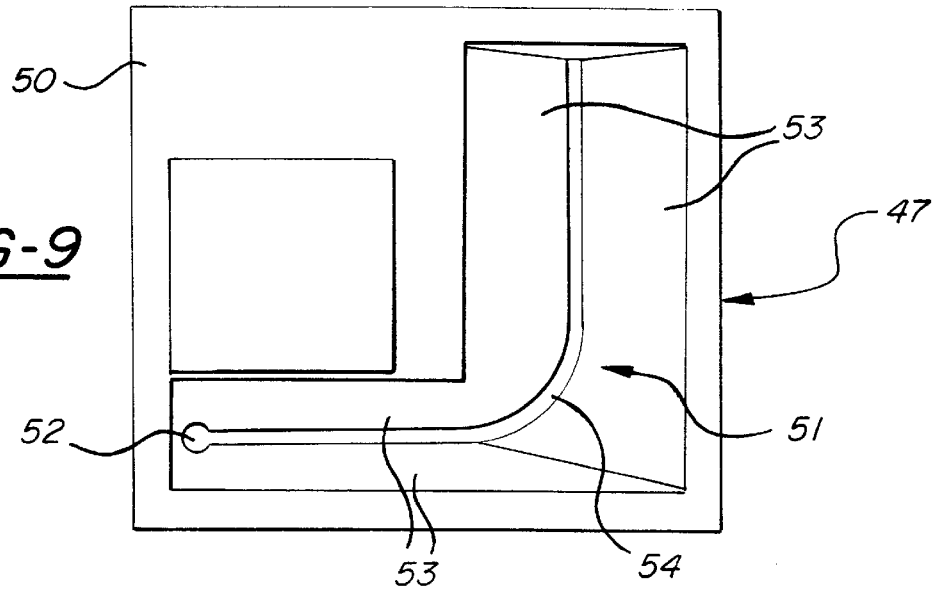
FIG. 9 is a top down view of the object sorting tray of one embodiment of the present invention.
Figure 9A:
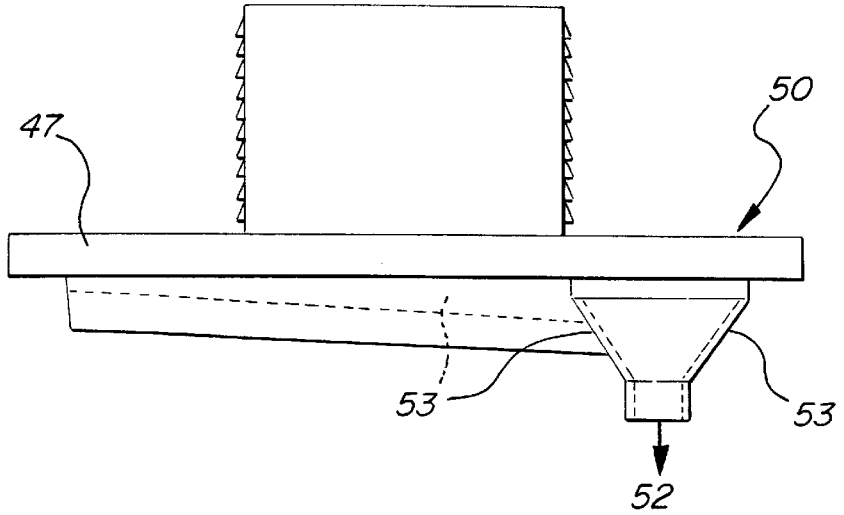
FIG. 9A is a lateral elevational view of the object sorting tray of FIG. 9.
Figure 9B:
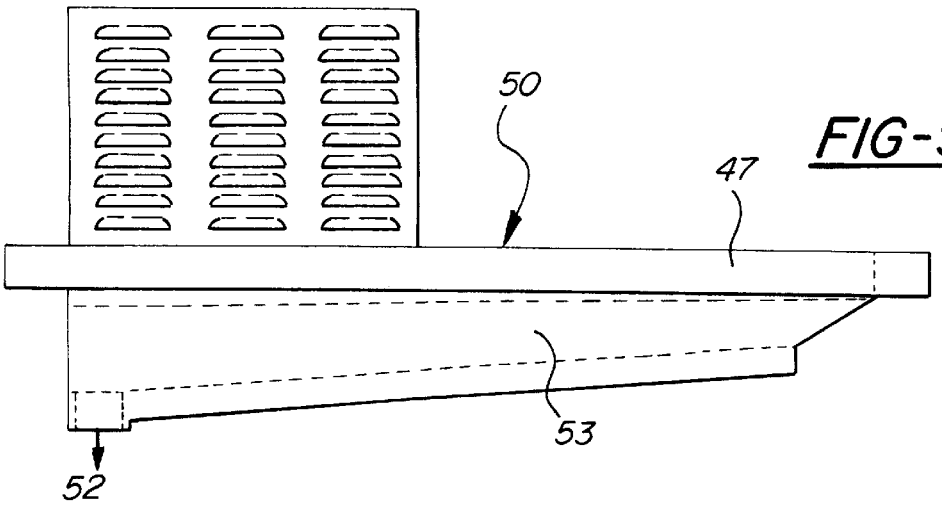
FIG. 9B is a frontal elevational view of the object sorting tray of FIG. 9.

Referring now to FIGS. 1 and 9 through 9C, housing inlet end preferably comprises an object sorting tray providing for the ordered conveyance of objects to cleaning element 1. The object sorting tray most generally defines an "L"-shaped basin 51 opening from top surface 50 of cover 47, as shown, the basin ramped downwardly towards opening 52 to provide for the gravity conveyance of objects thereto. Basin 51 is preferably formed integrally with cover 47. According to the most preferred embodiment of the present invention, shown in FIGS. 1 and 9 through 9B, basin 51 further includes inwardly sloping sidewalls 53 converging in a generally "L"-shaped, curvilinear object sorting track 54. As shown, sorting track 54 preferably comprises a single channel defined by spaced parallel walls. It is important that the distance between the walls of sorting track 54 be less than the diameter of the object to be cleaned, for example a typical golf ball, such that upper edges of the walls define a path for the conveyance of objects to be cleaned. The depth of object sorting track 54 should exceed the radius of objects to be cleaned, such that objects conveyed therealong will not touch the bottom of the channel. Object sorting track 54 terminates proximate opening 52, comprising a cylindrical passageway adapted to receive objects one at a time into housing 32.

According to an alternate embodiment (FIG. 9C), a plurality of shorter object sorting tracks 54' are provided in parallel-spaced relation along one section of basin 51', each track terminating at a separate opening 52' through cover 47'. As shown, each object sorting track 54' preferably comprises a single channel defined by spaced parallel walls, the distance between the walls of sorting track 54' being less than the diameter of the object to be cleaned, and the depth of track 54' exceeding the radius of objects to be cleaned, such that objects conveyed therealong will not touch the bottom of the channel.

Figure 10:
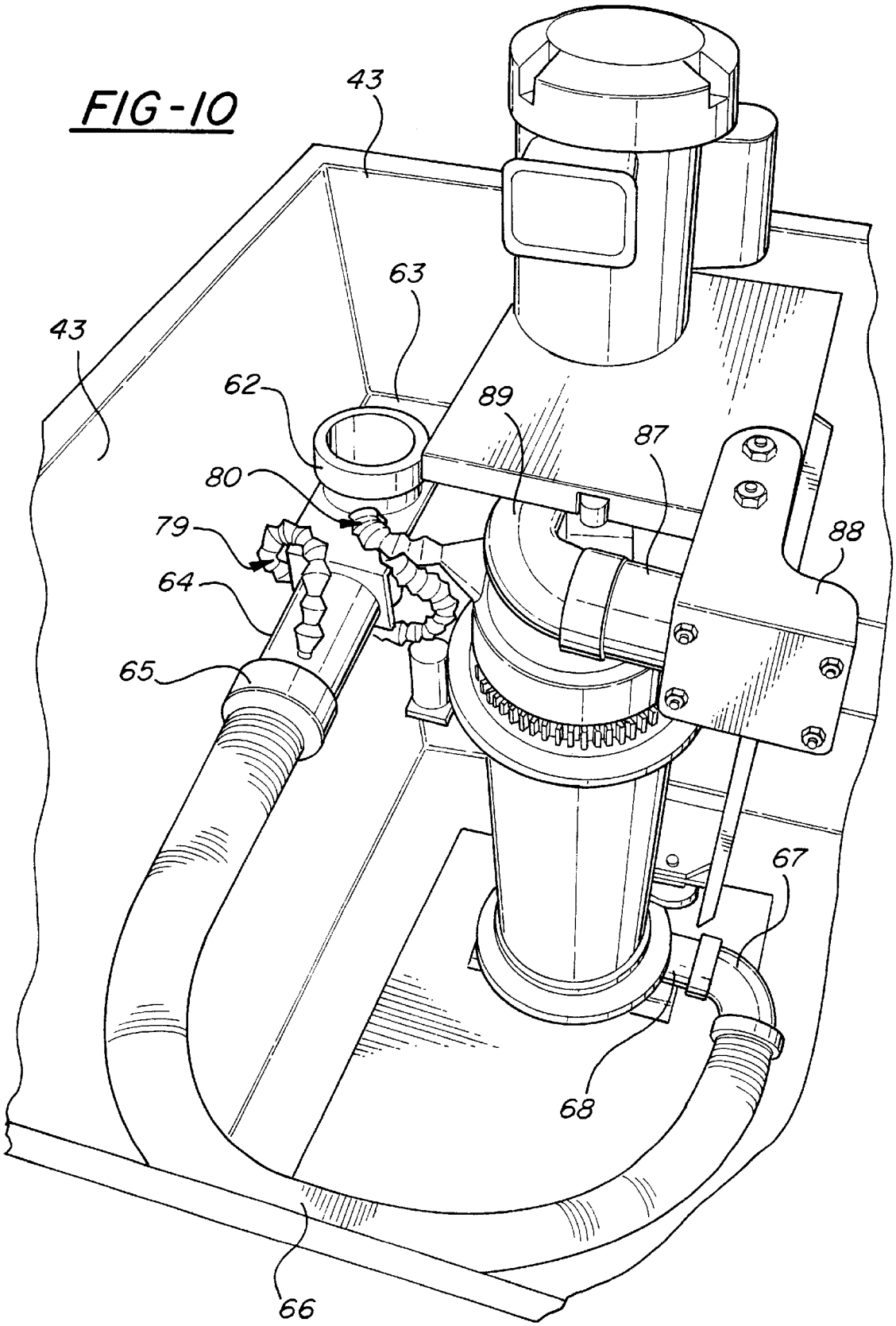
FIG. 10 is an interior quartering perspective of the housing of the present invention, depicting the object transfer conduit according to one embodiment thereof.

Turning to FIGS. 1 and 10, conveyance of objects, such as the illustrated golf balls, from basin 51 to cleaning element 1 will be better understood. According to the most preferred embodiment, opening 52 communicates with a first radiused joint section 62, which joint section communicates at its opposite end with a substantially horizontally oriented passageway 64. A corner bracket 63 secures joint section 62 to the interior rear side wall 43 of the upper half of the housing. Passageway 64 comprises a length of PVC pipe connected to and communicating a transfer conduit 66 by means of coupling 65. Transfer conduit 66 comprises a flexible hose extending between passageway 64 and vertically lower, third radiused joint section 67 provided at the opposite end thereof. Joint section 67 is fixed to and communicates with feed tube 68. In the illustrated embodiment, joint sections 62 and 67 preferably comprise 90 degree corner sections of commonly available PVC pipe, and may be fixed to passageway 64 and feed tube 68 using any suitable fastening means, including adhesive.

Figure 10A:
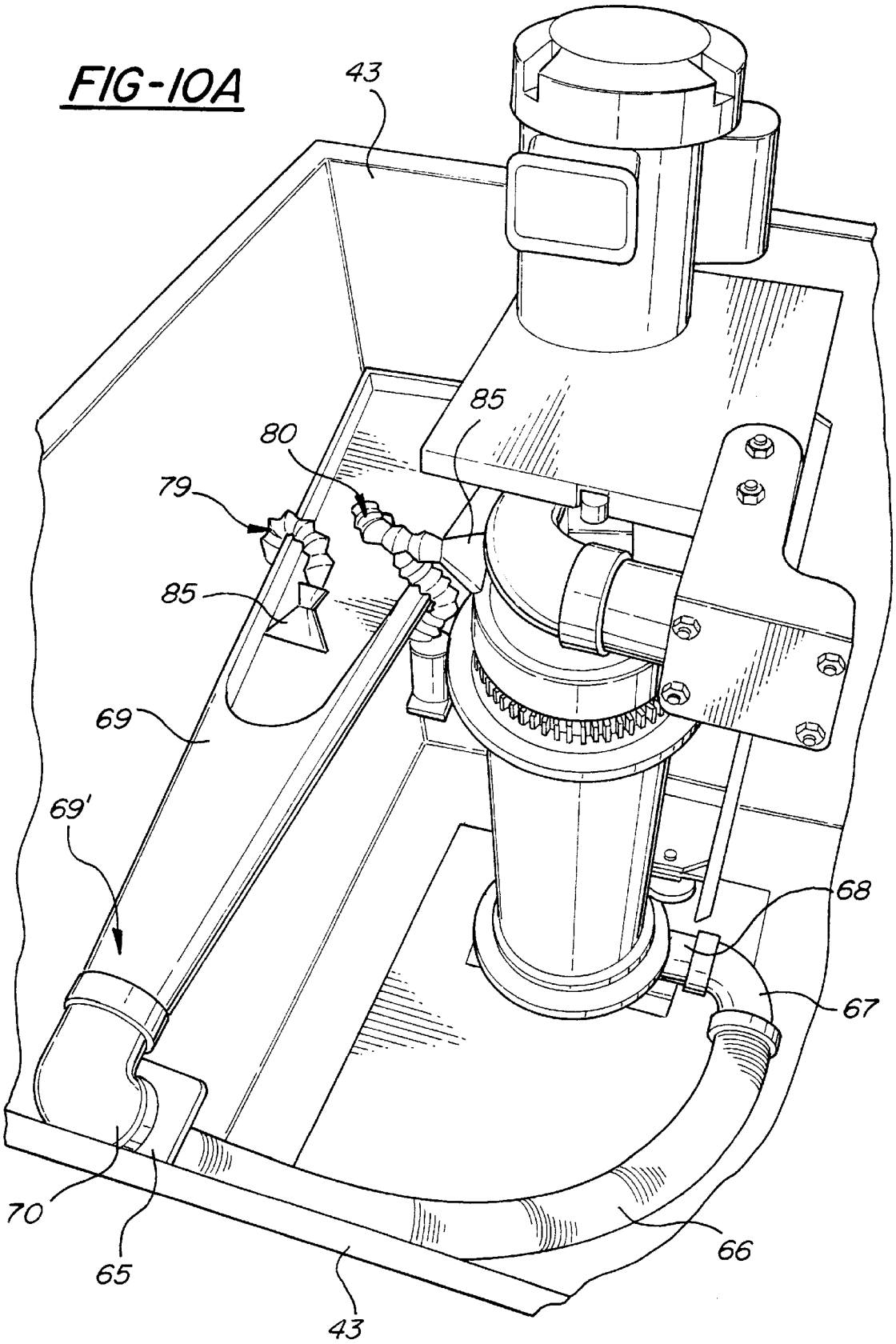
FIG. 10A is an interior quartering perspective of the housing of the present invention, depicting the object transfer conduit according to an alternative embodiment thereof.

According to an alternate embodiment, shown in FIG. 10A, a downwardly inclined or ramped chute 69 is provided vertically beneath openings 52 (not shown) interiorly of the housing. Chute 69 is fixed in place, via suitable fastening means such as screws or the like, to the interior rear side wall 43 of upper half of the housing proximate openings 52, and slopes downwardly therefrom towards discharge end 69'. Chute 69 is characterized by a decreasing cross-section along its length, the cross-section at discharge end 69' being adapted to permit the end-to-end passage of objects therethrough. Discharge end 70 communicates with radiused joint section 70, comprising a 90 degree corner section of PVC pipe fixed to the interior of front side wall 43 by corner bracket 63. Transfer conduit 66 extends between and communicates vertically spaced-apart radiused joint sections 70 and 67, joint section 67 communicating at the opposite end thereof with feed tube 68, as described above.

Referring again to FIG. 1, feed tube 68 is fixed to lower wall 16 of carriage 14 rearward of shaft 13 and track 11 by means of U-bolts 73. Feed tube 68 preferably comprises a cylindrical tube the internal diameter of which is slightly larger than the diameter of the object to be cleaned, such as, in the illustrated embodiment, a typical golf ball. Feed tube 68 communicates with radiused joint section 67 at a first end thereof, the opposite end thereof having a terminal opening. A portion of the wall of feed tube 68 is cut-away to define opening 71 adapted to accommodate the diameter of rotatable body 4 and permit shaft 13 and track 11 to be received in lower wall 16 of carriage 14. A guide flange 72 extending into opening 71 is provided to facilitate the conveyance of objects to cleaning element 1 and prevent their unwanted movement through opening 71 and into reservoir 39. Guide flange 72 is preferably dimensioned so as not to interfere in the rotation of rotatable body 4.

Figure 11:
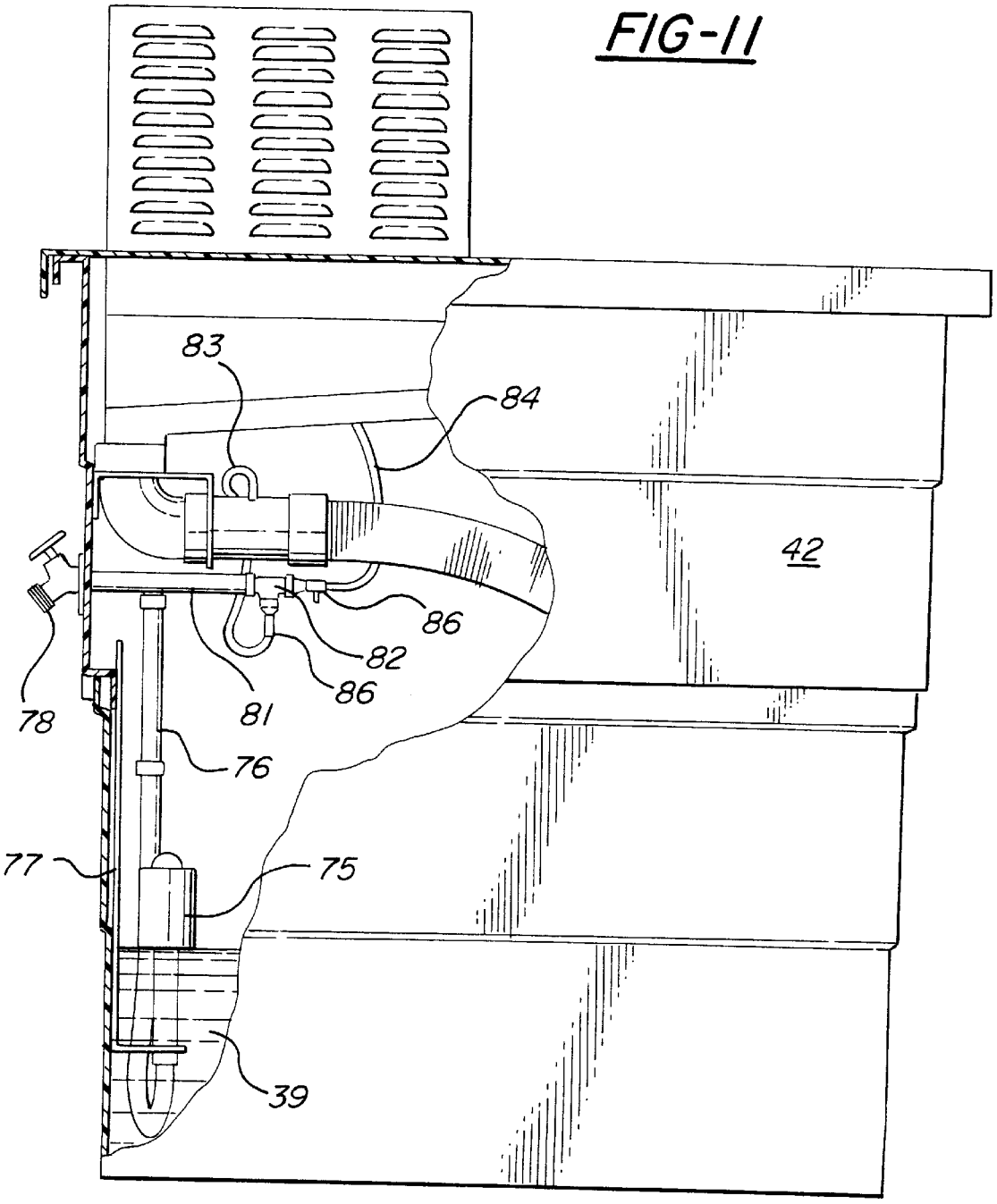
FIG. 11 is a lateral cut-away view of the housing of the present invention, illustrating the first and second rinse stations and automatic liquid supply valve.

Referring next to FIGS. 6, 10, 10A, and 11, first 74 and second 78 valved faucets on rear side-wall 43 of half 42 are accessible exteriorly of housing 32 and permit selective communication of cleaning liquid from an external source (not shown) with rinse stations 79 and 80 and automatic liquid supply valve 75. Referring particularly to FIG. 11, automatic liquid supply valve 75 preferably comprises a float valve of the type commonly known for regulating water levels in bathroom fixtures such as toilet bowls and the like, for automatically regulating the amount of liquid in reservoir 39. Liquid supply valve 75 communicates with an external supply of liquid (not shown) from first valved faucet 74 via supply conduit 76. Valve 75 is mounted to a bracket 77 fixed to upper half 42 so as to extend into reservoir 39. Actuation of valve 75 effects influx of fresh cleaning liquid when the liquid level in reservoir 39 falls below a predetermined minimum level; valve 75 arresting liquid influx when the level of cleaning liquid in reservoir 39 reaches a predetermined maximum level, preferably a height proximate the height of overflow drain 40 (not shown).

Referring to FIGS. 10, 10A, and 11, upper half 42 preferably includes at least first 79 and second 80 rinse stations interiorly thereof, both rinse stations communicating with an external supply of liquid (not shown). Preferably, both first 79 and second 80 rinse stations communicate with second valved faucet 78 via supply conduit 81. Supply conduit 81 diverges at a "T"-junction 82 into flexible, self-supporting supply conduits 83 and 84, each terminating in a spray nozzle 85. Valves 86 provided between "T"-junction 82 and supply conduits 83 and 84 permit selective flow of liquid into either or both of conduits 83 and 84, thereby permitting selective operation of rinse stations 79 and 80. In the preferred embodiment, first rinse station 79 is provided in passageway 64 (FIG. 10) in one embodiment or proximate ramped chute 69 (FIG. 10A) in an alternate embodiment so as to define a pre-cleaning rinse station. Second rinse station 80 is provided proximate outlet end 3 of cleaning element 1, as shown in both FIGS. 10 and 10A, so as to define an after-cleansing rinse station. Of course, it will be appreciated that additional rinse stations may be added according to user desire so as to augment object cleaning.

Referring now to FIGS. 1, 3, and 10, a discharge conduit 87 is provided proximate outlet end 3 of cleaning element 1. Discharge conduit 87 comprises a cylindrical passageway having an internal diameter adapted to permit the passage of cleansed objects therethrough in end-to-end relation. Discharge conduit 87 may be fabricated from PVC pipe, as shown, or other suitable material. A pair of "U" bolts (not shown) securely fix discharge conduit 87 along the principal length thereof to "L"-shaped support bracket 88 fastened to upper end wall 14 of carriage 13. A radiused section 89 communicating with conduit 87 is cut-away to define an inlet 90 thereto for objects exiting cleaning element 1. Discharge conduit 87 extends through outlet 34 in side wall 43 of upper half 42 of housing 30. While the force of discharge of objects from cleaning element 1 is sufficient to convey the objects a number of feet away from outlet end 3 of the cleaning element, it will be appreciated that the length of discharge conduit 87 between radiused section 89 and outlet 32 is dependent upon both the force and rate of object discharge at outlet 32.

Referring now to FIGS. 1, 9 through 9B, and 10, operation of the present invention in its application as a golf ball cleaning device according to the most preferred embodiment will be more fully understood. Upon loading in basin 51, golf balls 92 are urged inwardly along sloped walls 53 into object sorting track 54, along which they are gravity conveyed in end-to-end relation towards opening 52. As golf balls 92 move along sorting track 54, clumps of grass, stones, twigs, and other debris tends to collect in the channel thereof. Accordingly, such debris is not carried into housing 32 and cleaning element 1, where it could damage the cleaning element or the drive mechanism therefor. As golf balls pass one after the other through opening 52, they are conveyed by gravity in end-to-end relation through passageway 64 and vertically downward in end-to-end relation through transfer conduit 66 to feed tube 68. At the operators discretion, golf balls 92 may be subject to rinsing at prior to reaching cleaning element 1 at first rinse station 79 as they are conveyed through passageway 63. At feed tube 68, golf balls 92 advance in end-to-end relation and are successively conveyed vertically upwards along helical track 11 by the rotational movement of rotatable body 4; first abrasive object cleaning surface 5 acting on golf balls 92 to urge them vertically upwards along track 11 between inlet 2 and outlet 3 ends. Because at least inlet end 2 of cleaning element 1 is preferably submerged in and exposed to the cleaning liquid in reservoir 39, it will be appreciated that objects are conveyed wet through cleaning element 1, facilitating thorough cleaning of the objects. It will also be appreciated that the present inventive cleaning device provides efficacious cleaning of the objects by virtue of the cleaning action of the at least first and second abrasive object cleaning surfaces. As golf balls 92 exit cleaning element 1 at outlet end 3, they may, at the operators option, be subjected to a second rinsing at rinse station 80, which rinsing is preferably carried out using fresh water. From outlet end 3, golf balls 92 travel in end-to-end relation horizontally away from cleaning element 1 through discharge conduit 87 to outlet 32, urged along by the force of discharge from cleaning element 1. Upon exiting housing 32 at outlet 34, the golf balls may be collected in a suitable receptacle 91.

Those of skill will understand that over time, due in part to evaporation, the level of cleaning liquid in reservoir 39 will diminish. As this occurs, valve 75 responds to such change in the level of cleaning liquid away from the predetermined minimum for proper functioning of the device, causing reservoir 39 to be re-filled from an external liquid source (not shown) via first valved faucet 74. As the level of cleaning liquid is normalized, valve 75 functions to terminate the influx of additional cleaning liquid.

What is claimed is:

1. An object cleaning device, comprising:

a cleaning element having an inlet end for receiving objects and an outlet end for discharging objects, said cleaning element further comprising a rotatable body including at least a first interior object cleaning surface, and a stationary track interior of said rotatable body, said stationary track defining a path of travel for objects between said inlet end and said outlet end; and a drive mechanism for rotating said rotatable body relative to said stationary track such that rotation of said rotatable body relative to said stationary track causes the movement of objects from said inlet end to said outlet end along said stationary track.

2. The object cleaning device of claim 1, wherein both said rotatable body and said stationary track are substantially vertically oriented, whereby rotation of said rotatable body relative to said stationary track moves the objects upwards along said stationary track from said inlet end to said outlet end of said cleaning element.

3. The object cleaning device of claim 2, wherein said cleaning element further includes at least a second object cleaning surface.

4. The object cleaning device of claim 3, wherein said at least first and second object cleaning surfaces are radially opposed and spaced apart such that an object being cleaned is simultaneously acted upon by both said at least first and second object cleaning surfaces.

5. The object cleaning device of claim 4, wherein said cleaning element further comprises a stationary shaft provided interior of said stationary track, said shaft including said at least second, object cleaning surface.

6. The object cleaning device of claim 5, wherein said stationary track comprises a helix.

7. The object cleaning device of claim 1, further including at least a first rinse station communicating with a supply of liquid, said at least first rinse station for rinsing objects in said object cleaning device.

8. The object cleaning device of claim 7, further including at least a second rinse station communicating with a supply of liquid, wherein said at least first rinse station is provided prior to said inlet end of said cleaning element, and said at least second rinse station is provided after said outlet end of said cleaning element.

9. The object cleaning device of claim 8, wherein said supply of liquid is a common supply of liquid, and said at least first and second rinse stations further comprise a valved liquid supply conduit such that said at least first and second rinse stations are independently selectively operable.

10. The object cleaning device of claim 1, further comprising a reservoir containing a cleaning liquid, said cleaning element receiving objects from said reservoir at said inlet end thereof.

11. The object cleaning device of claim 10, further including an automatic liquid supply valve communicating with a supply of cleaning liquid, said automatic liquid supply valve automatically regulating the amount of cleaning liquid in said reservoir.

12. The object cleaning device of claim 11, further comprising a housing containing at least said reservoir and said cleaning element, said housing including an inlet communicating with said inlet end of said cleaning element, and an outlet communicating with said outlet end of said cleaning element.

13. The object cleaning device of claim 12, wherein said housing comprises at least first and second hingedly connected halves.

14. The object cleaning device of claim 13, wherein said reservoir is defined in one of said at least first and second hingedly connected halves.

15. The object cleaning device of claim 1, further comprising a housing containing at least said cleaning element, said housing comprising an inlet end communicating with said inlet end of said cleaning element, an outlet end communicating with said outlet end of said cleaning element, and at least one object sorting track provided prior to said inlet end of said cleaning element, said at least one object sorting track separating debris from the objects to be cleaned.

16. The object cleaning device of claim 15, wherein said at least one object sorting track comprises a channel having spaced-apart walls, each said spaced-apart wall including an upper edge, said upper edges defining a path of travel for the objects, and said channel further having a depth below said path for receiving debris from the objects.

17. The object cleaning device of claim 16, wherein said inlet of said housing comprises a basin having inwardly sloping side walls for gravity conveyance of objects to be cleaned to said at least one object sorting track.

18. The object cleaning device of claim 17, wherein said housing includes a cover, said cover including said inlet end of said housing, and wherein said basin and said at least one object sorting track are provided on said cover.

19. The object cleaning device of claim 18, wherein said basin and said at least one object sorting track are further ramped to provide for gravity conveyance of objects to be cleaned to said inlet end of said housing.

20. An object cleaning device, comprising:

a cleaning element having an inlet end for receiving objects and an outlet end for discharging objects, said cleaning element further comprising a rotatable body including at least a first interior object cleaning surface, and a stationary track interior of said rotatable body, said stationary track defining a path of travel for objects between said inlet end and said outlet end;

a drive mechanism for rotating said rotatable body relative to said stationary track such that said rotatable body moves objects from said inlet end to said outlet end along said stationary track;

at least a first rinse station communicating with a supply of liquid, said at least first rinse station for rinsing objects in said object cleaning device;

a reservoir containing a cleaning liquid, said cleaning element receiving objects from said reservoir at said inlet end thereof; and a housing containing at least said cleaning element, said housing comprising an inlet end communicating with said inlet end of said cleaning element, an outlet end communicating with said outlet end of said cleaning element, and at least one object sorting track provided prior to said inlet end of said cleaning element, said at least one object sorting track separating debris from the objects.

21. The object cleaning device of claim 20, wherein both said rotatable body and said stationary track are substantially vertically oriented, whereby rotation of said rotatable body relative to said stationary track moves the objects upwards along said stationary track from said inlet end to said outlet end of said cleaning element.

22. The object cleaning device of claim 21, wherein said cleaning element further includes at least a second object cleaning surface.

23. The object cleaning device of claim 22, wherein said at least first and second object cleaning surfaces are radially opposed and spaced apart such that an object being cleaned is simultaneously acted upon by both said at least first and second object cleaning surfaces.

24. The object cleaning device of claim 23, wherein said cleaning element further comprises a stationary shaft provided interior of said stationary track, said shaft including said at least second object cleaning surface.

25. The object cleaning device of claim 24, wherein said stationary track comprises a helix.

26. The object cleaning device of claim 20, further including at least a second rinse station communicating with a supply of liquid, wherein said at least first rinse station is provided prior to said inlet end of said cleaning element, and said at least second rinse station is provided after said outlet end of said cleaning element.

27. The object cleaning device of claim 26, wherein said supply of liquid is a common supply of liquid, and said at least first and second rinse stations further comprise a valved liquid supply conduit such that said at least first and second rinse stations are independently selectively operable.

28. The object cleaning device of claim 20, further including an automatic liquid supply valve communicating with a supply of cleaning liquid, said automatic liquid supply valve automatically regulating the amount of cleaning liquid in said reservoir.

29. The object cleaning device of claim 20, wherein said housing comprises at least first and second hingedly connected halves.

30. The object cleaning device of claim 29, wherein said reservoir is defined in one of said at least first and second hingedly connected halves.

31. The object cleaning device of claim 20, wherein said at least one object sorting track comprises a channel having spaced-apart walls, each said spaced-apart wall including an upper edge, said upper edges defining a path for the conveyance of the objects, and said channel further having a depth below said path for receiving debris from the objects.

32. The object cleaning device of claim 31, wherein said inlet of said housing comprises a basin having inwardly sloping side walls for gravity conveyance of objects to be cleaned to said at least one object sorting track.

33. The object cleaning device of claim 32, wherein said housing includes a cover, said cover including said inlet end of said housing, and wherein said basin and said at least one object sorting track are provided on said cover.

34. The object cleaning device of claim 33, wherein said basin and said at least one object sorting track are further ramped to provide for gravity conveyance of objects to be cleaned to said inlet end of said housing.

* * * * *